US005584674A

United States Patent [19]

Mo

[11] Patent Number: 5,584,674

[45] Date of Patent: Dec. 17, 1996

[54] NOISE ATTENUATOR OF COMPRESSOR

[75] Inventor: Jin-Yong Mo, Seoul, Rep. of Korea

[73] Assignee: Samsung Electronics Co., Ltd., Suwon, Rep. of Korea

[21] Appl. No.: 229,714

[22] Filed: Apr. 19, 1994

[30] Foreign Application Priority Data

Apr. 24, 1993 [KR] Rep. of Korea ..... 93-6585

[51] Int. Cl.[6] ..... F04B 39/00

[52] U.S. Cl. ..... 417/312; 417/902; 181/403

[58] Field of Search ..... 181/229, 272, 181/273, 403, 296; 417/312, 902

[56] References Cited

U.S. PATENT DOCUMENTS

| | | | |
|---|---|---|---|
| 3,785,167 | 1/1974 | Sahs | 181/229 |
| 4,109,751 | 8/1978 | Kabele | 181/229 X |
| 4,239,461 | 12/1980 | Elson | 417/312 |
| 4,313,715 | 2/1982 | Richardson, Jr. | 417/312 |
| 4,371,054 | 2/1983 | Wirt | 181/272 |
| 4,401,418 | 8/1983 | Frichman | 417/312 |
| 4,990,067 | 2/1991 | Sasano et al. | 417/312 |

*Primary Examiner*—Khanh Dang

*Attorney, Agent, or Firm*—Burns, Doane, Swecker & Mathis, L.L.P.

[57] ABSTRACT

A noise attenuator for a refrigerant-circulating compressor includes a casing whose interior space is divided into first and second chambers. The first chamber has an inlet for receiving refrigerant and is connected by a conduit with the second chamber. Additional conduits connect the second chamber with the compressor inlet. The cavity length L of the first chamber is determined as a function of a compressor noise to be attenuated, using the formula fr=C/4L (2n+1), where fr is the frequency of the noise, C is the speed of sound in refrigerant, and n is any whole integer (including zero). The first chamber may comprise a first portion and a second portion in the form of a branch line, with the cavity length L being defined by a combination of both of the portions.

1 Claim, 8 Drawing Sheets

——— CONVENTIONAL TRANSMISSION LOSS RESULT

- - - - TRANSMISSION LOSS OF PRESENT INVENTION OF FIG. 4

NOISE ATTENUATOR OF COMPRESSOR

BACKGROUND OF THE INVENTION

1. Field of the Invention

The present invention relates to a noise attenuator for attenuating noises generated from a compressor of a refrigerator, an air conditioner or the like, and more particularly to a noise attenuator of a compressor for attenuating noises generated from valves disposed within the compressor.

2. Description of the Prior Art

Generally, a compressor is constructed to comprise a driving unit and a compressing unit sealed in an airtight case 1, as illustrated in FIG. 1.

The driving unit comprises a motor, which in turn, is composed of a rotor 2 and a stator 3.

The rotor 2 is equipped with a rotary shaft 6.

The compressing unit comprises: a crank shaft 5 eccentrically jointed to a lower end of the rotary shaft 6 of the driving unit; a connecting rod 9 for transforming a rotary movement of the crank shaft to a reciprocating motion by being rotatively jointed to the crank shaft 5; a piston 7 for performing a reciprocating motion by being rotatively jointed to the connecting rod 9; a cylinder 8 for receiving the piston 7; and a head cover 4 jointed to one side of the cylinder 8.

Meanwhile, a noise attenuator 10 is disposed on an upper side of the cylinder 8 in order to attenuate noises generated from the cylinder 8.

The noise attenuator 10 is connected to a suction pipe 12 which is, in turn, connected to an accumulator (not shown).

The reciprocating compressor thus constructed, mainly being installed on a refrigerator, air conditioner or the like, sucks in refrigerant gas to compress the same for discharge thereafter, and when the rotor 2 is rotated by power supplied to the motor comprising the stator 2 and the rotor 3, the rotary shaft 6 is rotated in accordance with the rotation of the rotor 2.

As the rotary shaft 6 is rotated, so is the crank shaft 5 rotated, and when the crank shaft 5 is rotated, the connecting rod 9 begins a linear reciprocating motion.

When the connecting rod 9 starts the linear reciprocating motion, the piston 7 reciprocatively moves within the cylinder 8.

In other words, the piston performs an intake stroke for intaking the refrigerant gas into the cylinder 8 and a discharge stroke for compressing the refrigerant gas sucked into the cylinder 8 to thereafter discharge the same.

During the intake stroke, the refrigerant gas infused through the accumulator is sucked into the cylinder 8 through the intake pipe 12 and the noise attenuator 10.

The refrigerant gas sucked into the cylinder 8 is compressed by the piston 7 in high temperature and high pressure and is discharged outside of the cylinder 8 to thereby be supplied to a condenser (not shown).

In other words, the refrigerant gas is infused into the cylinder 8 through the head cover 4 disposed at one side of the cylinder 8 and through a suction valve (not shown) during the intake stroke, and the refrigerant gas, after being compressed in high temperature and high pressure, is discharged to the condenser (not shown) through a discharge valve (not shown) and the head cover 4 disposed at one side of the cylinder 8 during the discharge stroke.

As seen from the aforesaid, the noise generated by the closing and opening of the suction valve and the discharge valve during the intake and discharge strokes, and the noise is attenuated by the noise attenuator 10.

FIG. 2 is a sectional view for illustrating construction of a conventional noise attenuator 10.

According to FIG. 2, the conventional attenuator 10 comprises: an external case 11 having an inner space; a separation member 14 for partitioning the inner space into an upper chamber 13*a* and a lower chamber 13*b*; a suction hole or part 15 for interconnecting the suction pipe 12 (see FIG. 1) and the upper chamber 13*a* to thereby let the refrigerant gas to be infused into the upper chamber 13*a* from the suction pipe 12; a passage in the form of a connecting pipe 16 for piercing through the separation member 14 to thereby connect the upper chamber 13*a* and the lower chamber 13*b*; and passage in the form of infuse pipes 18*a* and 18*b* for supplying the refrigerant gas infused into the lower chamber 13*b* to the cylinder head 4 of a suction chamber 4*a*.

The reference numeral 4*b* designates a discharge chamber.

The noise attenuator 10 thus constructed is compelled to receives a noise generated by way of the closing and opening of the suction valve and the discharge valve disposed between the cylinder head 4 and the cylinder 8 (see FIG. 1), and the generated noise is attenuated in the course of passing through the infuse pipes 18*a* and 18*b*, lower chamber 13*b*, connecting pipe 106 and the upper chamber 13*a* which happens to have a cavity length of l.

At this time, the noise attenuator 10 has attenuated the noise as illustrated in solid lines in FIGS. 5 and 6.

According to each of FIGS. 5 and 6, the conventional noise attenuator 10 has shown a best noise transmission loss or reduction (the loss=inputted noise value–outputted noise value) at around 1,400 Hz.

Generally speaking, a higher transmission loss equates to a lower penetration efficiency of sound waves.

However, the noise generated by way of closing and opening of the suction valve and the discharge valve in the compressor is generally produced at around 500 Hz, which can hardly be attenuated by the noise attenuator 10 effectively.

In other words, as illustrated in FIGS. 5 and 6, the noise attenuator 10 has a transmission loss of less than 30 dB at around 500 Hz, and if it is assumed that the inputted noise value is 100 dB, the actual noise value transmitted to a user is a rather high noise of 70 dB.

As mentioned above, the conventional attenuator has a low transmission loss at around 500 Hz, so that the noise generated from the valves of the compressor is not only transmitted intact to the outside, but also the vibration resulting from the noise causes frequent inoperation, thereby causing degradation of the quality of the product.

SUMMARY OF THE INVENTION

The present invention has been disclosed to solve the aforementioned problems, and it is an object of the present invention to provide a noise attenuator of a compressor for attenuating noise having a predetermined range of frequency generated from valves of the compressor.

The object of the present invention is attained by a noise attenuator of a compressor which has a maximum value of transmission loss transmitted to a predetermined range by way of extending a cavity length of a first space, the noise attenuator comprising: a case member having an inner space; a separation member for partitioning the inner space of the case member into a first and a second space; and a refrigerant suction means for infusing refrigerant gas into a refrigerant compression means through the first and second space.

BRIEF DESCRIPTION OF THE DRAWINGS

Other objects and aspects of the invention will become apparent from the following description of embodiments with reference to the accompanying in which.

DETAILED DESCRIPTION OF THE INVENTION

First Embodiment

Figure 3A:
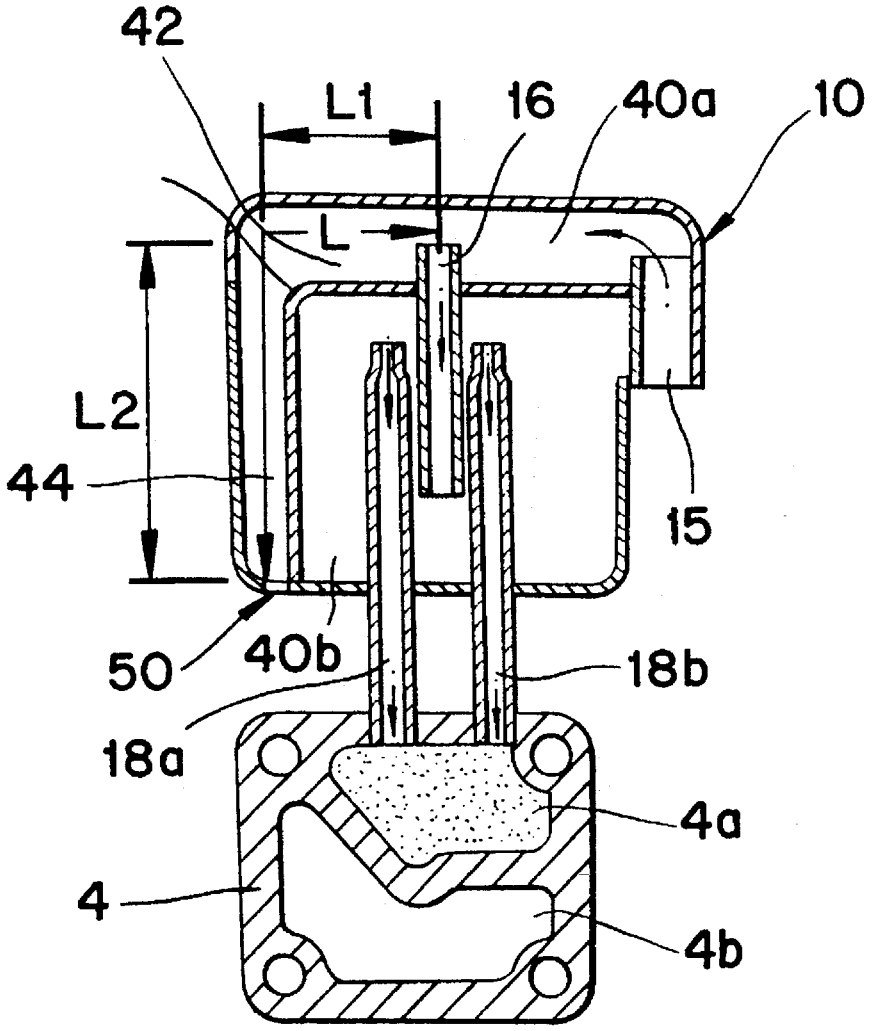
FIG. 3A, 3B and 3C are sectional views for illustrating embodiments of the noise attenuator in accordance with the present invention.

FIG. 3A is a sectional view for illustrating a first embodiment of the noise attenuator in accordance with the present invention.

According to FIG. 3A, the noise attenuator 10 is partitioned into an upper chamber 40*a* and a lower chamber 40*b* by the separation member 30 in the inner space thereof.

At this time, the upper chamber 40*a* of the noise attenuator 10 includes a main or upper area 42 and a branch line in the form of a lateral area 44 (a lateral area opposite from a suction hole 15) branching from a downstream end of the upper area 42 and extending perpendicular thereto.

The cavity length L of the upper chamber 40*a* is L1+L2, where L1 is a distance from a center of the connecting pipe 16 for connecting the upper chamber 40*a* and the lower chamber 40*b* to a center of the lateral area 44 and L2 is a distance from a center of the upper area 42 to a lowest end of the lateral area 44.

An exit orifice 50 is formed on the lowest end of the upper chamber 40*a*, i.e., on the lowest end of the lateral area 44.

The exit orifice 50 enables oil collected in the upper chamber 40*a* to be retrieved.

Meanwhile, one end of the upper chamber 40*a* is disposed with the suction hole 15.

Therefore, the refrigerant gas is infused into the upper chamber 40*a* through the suction hole 15. The refrigerant gas infused into the upper chamber 40*a* passes through the separation member 30 and is infused to the lower chamber 40*b* through the connecting pipe 16 for connecting the upper chamber 40*a* and the lower chamber 40*b*.

The refrigerant gas in the lower chamber 40*b* is infused into a suction chamber 4*a* of the cylinder head 4 through the infuse pipes 18*a* and 18*b*.

The reference numeral 4*b* is a discharge chamber.

The operation and effect of the first embodiment thus constructed according to the present invention will be described, referring to the accompanying drawings.

Figure 1:
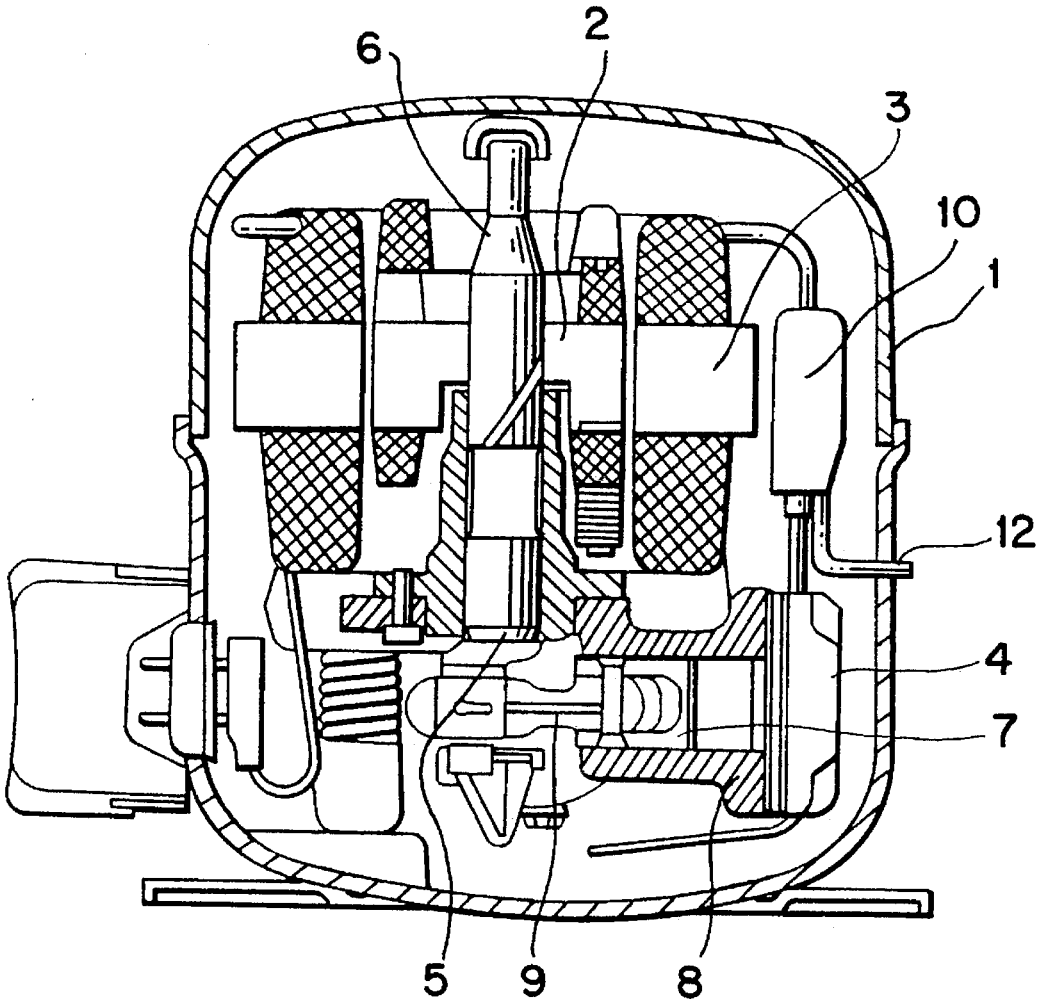
FIG. 1 (PRIOR ART)
FIG. 1 is a sectional view for illustrating an inner construction of a conventional compressor.
Figure 2:
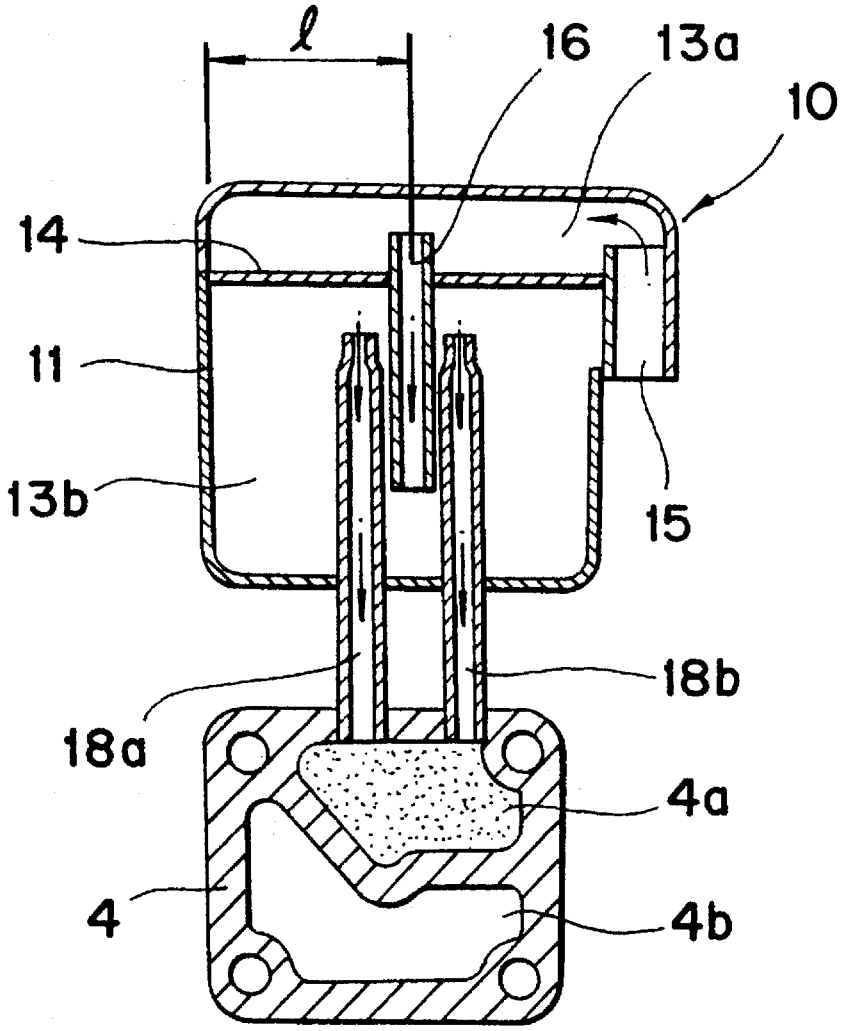
FIG. 2 (PRIOR ART)
FIG. 2 is a cutaway view for illustrating construction of a conventional noise attenuator.

First of all, the refrigerant gas in the suction chamber 4*a* is infused into the cylinder 8 (see FIG. 1) in accordance with the movement of the piston 7 during the intake stroke.

When the gas is infused into the cylinder 8 as mentioned above, the refrigerant is infused into the upper chamber 40*a* from an evaporator (not shown) through the suction hole 15, as per the arrow direction illustrated in FIG. 3A.

The refrigerant gas infused into the upper chamber 40*a* flows into the lower chamber 40*b* through the connecting pipe 16.

The refrigerant gas in the lower chamber 40*b* is infused into the suction chamber 4*a* of the cylinder head 4 through the infuse pipes 18*a* and 18*b*.

The refrigerant gas infused into the suction chamber 4*a* flows into the cylinder 8 through a suction valve (not shown).

Next, the refrigerant gas is compressed in the cylinder 8 by the piston 7 and is discharged to the outside of the cylinder 8 through the discharge valve (not shown).

At this time, the suction valve disposed on the cylinder head 4 is opened when the refrigerant gas is sucked into the cylinder 8 and is closed when the gas is compressed to thereby be discharged.

Furthermore, the discharge valve disposed on the cylinder head 4 is closed when the gas is sucked into the cylinder 8, and is opened when the gas is compressed to thereby be discharged, as against the suction valve.

Noise is generated as the valves are opened and closed as mentioned in the aforesaid, and the noise usually possesses 500 Hz of frequency.

The noise generated by the valves is transmitted in a direction opposite the direction of the refrigerant gas flow.

In other words, the noise generated from the valves of the cylinder head 4 is transmitted to the outside through the infuse pipes 18*a* and 18*b*, lower chamber 40*b*, connecting pipe 16, upper chamber 40*a*, suction hole 15 and the like.

At this time, as seen from the foregoing, the noise of 500 Hz range generated from the valves is attenuated at the upper chamber 40*a*.

In other words, as seen from the following formula 1, the frequency fr where the transmission loss is peaked becomes lower as the cavity length L is lengthened, and the cavity length L of the upper chamber 40*a* is made to be L1+L2 as mentioned above, so that the peak attenuation of noise occurs at 500 Hz.

$$fr = (C/4L)(2n+1) \text{ or } L = \frac{C(2n+1)}{4fr} \qquad \text{Formula 1}$$

(where, C is speed of sound in refrigerant and n=any whole number such as 0, 1, 2, · · ·.)

Accordingly, let's assume that the frequency fr where the transmission loss is peaked is 500 Hz, then, the cavity length L of the upper chamber 40*a* according to Formula 1 is 75 mm.

$$fr = C/4L(2n+1) = 150{,}000/4 \times 75|_{n=0} = 500\text{Hz}.$$

(where, inner temperature of the noise attenuator is 34 degrees celsius and the speed of sound C in the refrigerant is given 150 m/sec.)

Figure 5:
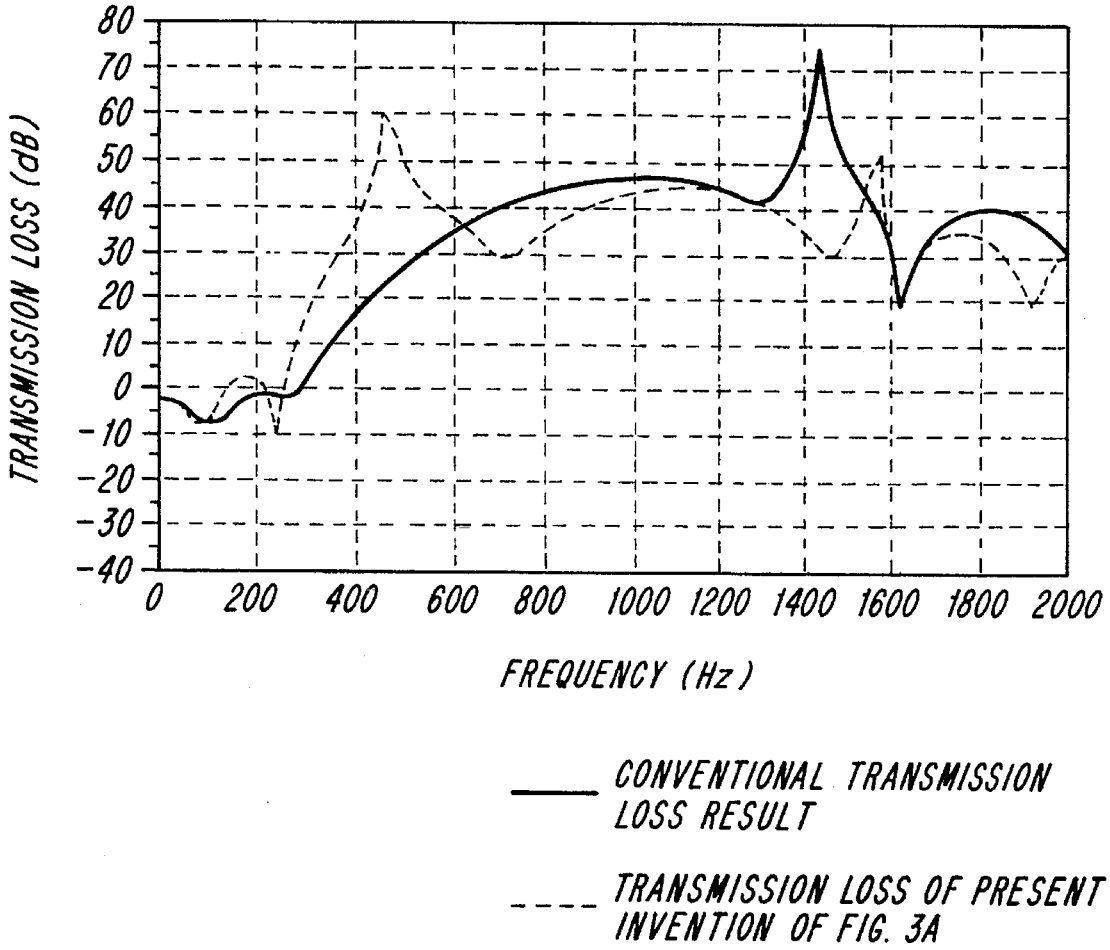
FIG. 5 and 6 are graphs for illustrating transmission losses of the conventional noise attenuator and the noise attenuator in accordance with the present invention respectively.

As mentioned above if the cavity length L of the upper chamber 40*a* is lengthened, the transmission loss can be given as illustrated in dotted lines at FIG. 5.

In other words, the transmission loss at 500 Hz range as illustrated in FIG. 5 is 60 dB, which is considerably high.

If the noise value transmitted to the upper chamber 40*a* is 100 dB, the noise value transmitted to a user, that is, outputted noise value, becomes 40 dB, which is low enough to give only minimum damage to the user. Thus, in contrast to the prior art, the cavity length L of the chamber 40*a* is specifically dimensioned as a function of the frequency of the compressor noise (i.e., is dimensioned in accordance with Formula 1, above) to provide an optimum noise attenuation. By configuring the chamber 40*a* as having non-colinear portions 42, 44, rather than as a single, long linear portion, the size of the attenuator can be kept within desired limits while still providing the requisite cavity length L.

Second Embodiment

Figure 3B:
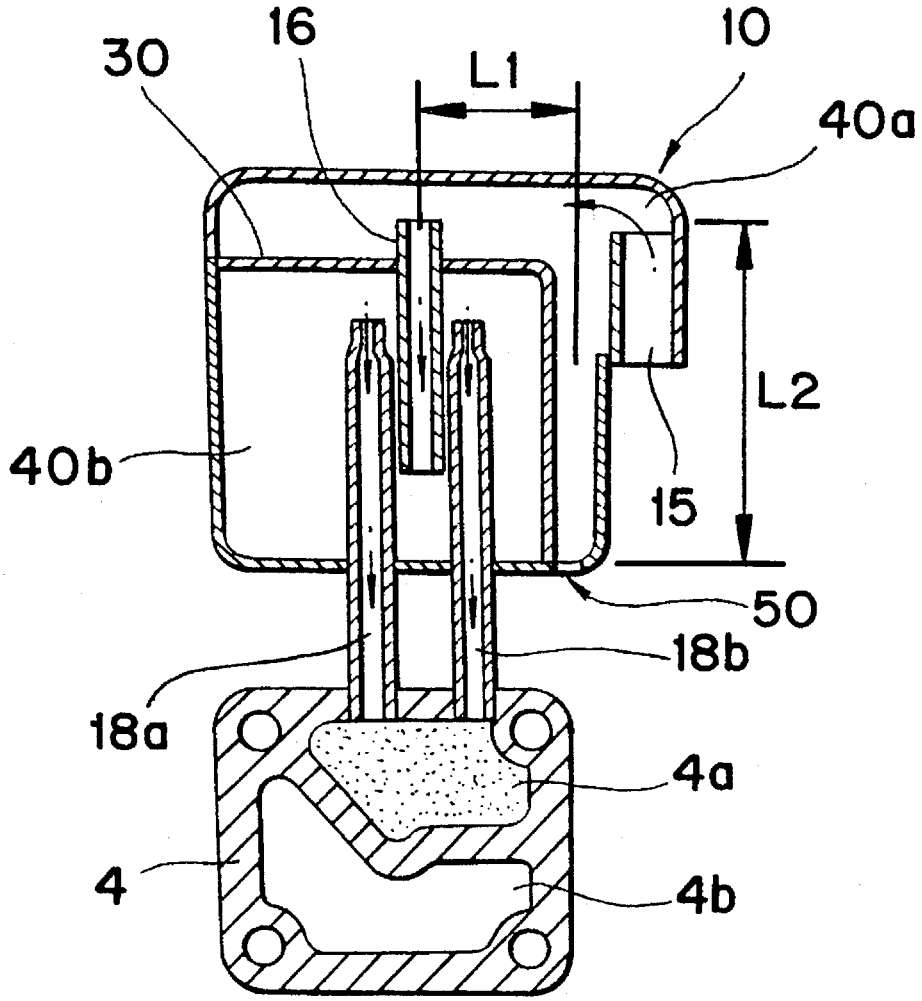

FIG. 3B is a sectional view of a second embodiment for a noise attenuator according to the present invention.

In the second embodiment, same reference numerals are given to the parts having identical functions as those in the first embodiment.

The difference between the first embodiment and the second embodiment illustrated in FIG. 3B is that in the second embodiment the branch line is in the form of a lateral area 46 located adjacent to the suction hole 15.

Accordingly, the cavity length L of the upper chamber 40*a* in the second embodiment also becomes L1+L2, thus functioning in the same manner as in the first embodiment.

Third Embodiment

Figure 3C:
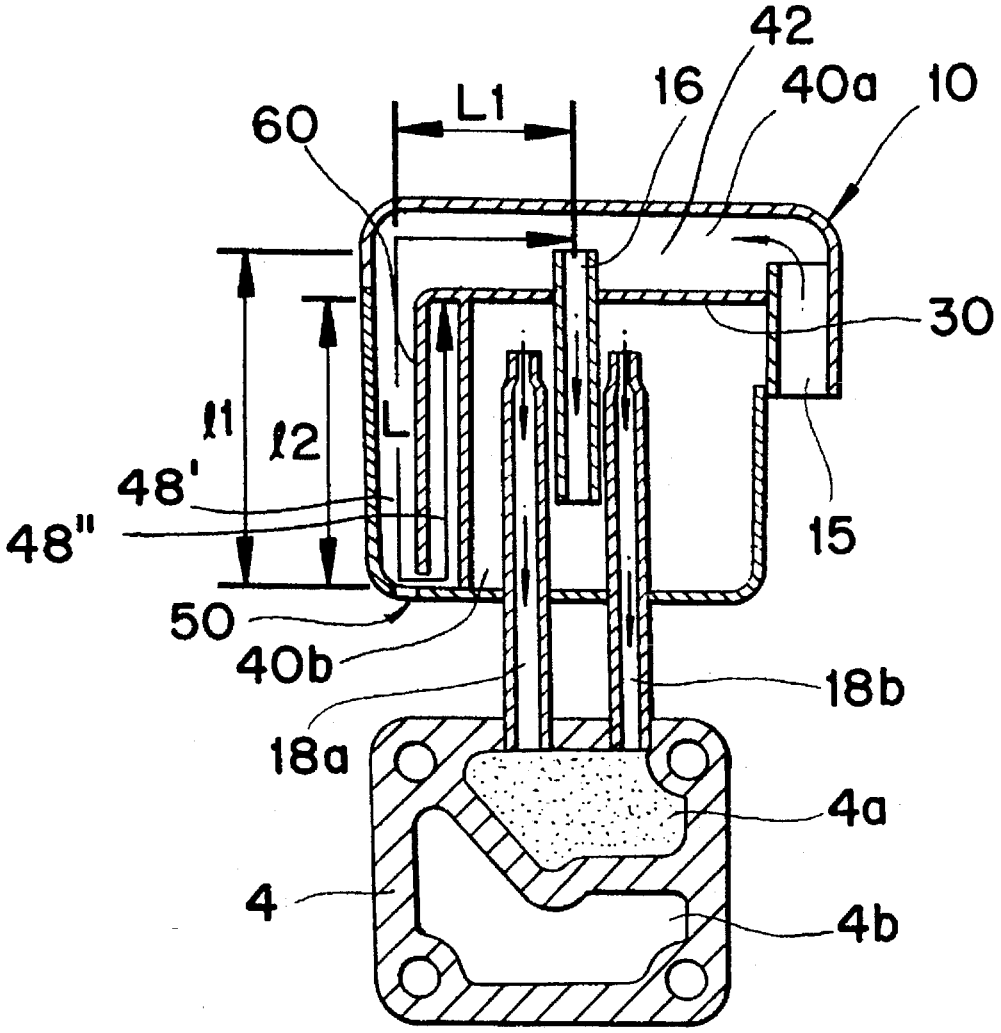

FIG. 3C is a sectional view of a third embodiment of the noise attenuator according to the present invetnion.

In the third embodiment, same reference numerals are given to the parts having identical functions as those in the first embodiment.

The difference between the first embodiment and the third embodiment illustrated in FIG. 3C is that the branch line comprises a lateral area having outer and inner segments 48', 48", due to the presence of a rib member 60 projecting downwardly from the upper surface of the separation member 30.

In accordance with the above extensions, the upper chamber 40*a* comes to have two additional lateral areas 4', 48 of predetermined lengths l1 and l2, respectively.

At this time, summation the two additional lateral areas 1 and 2 becomes L2, which is the same as the extended cavity length L2 at the first or second embodiment, as shown in Formula 2.

$$l1+l2=L2 \qquad \text{Formula 2}$$

By way of example, let's assume that the frequency fr where the transmission loss is peaked is 500 Hz, then, the cavity length L becomes 75 mm, which now becomes a total length of L1+L2, in other words, L1+l1+l2.

Thererfore, even in the third embodiment, the cavity length L of the upper chamber 40*a* becomes L1+L2, which operates in the same manner as in the first embodiment.

Fourth Embodiment

Figure 4:
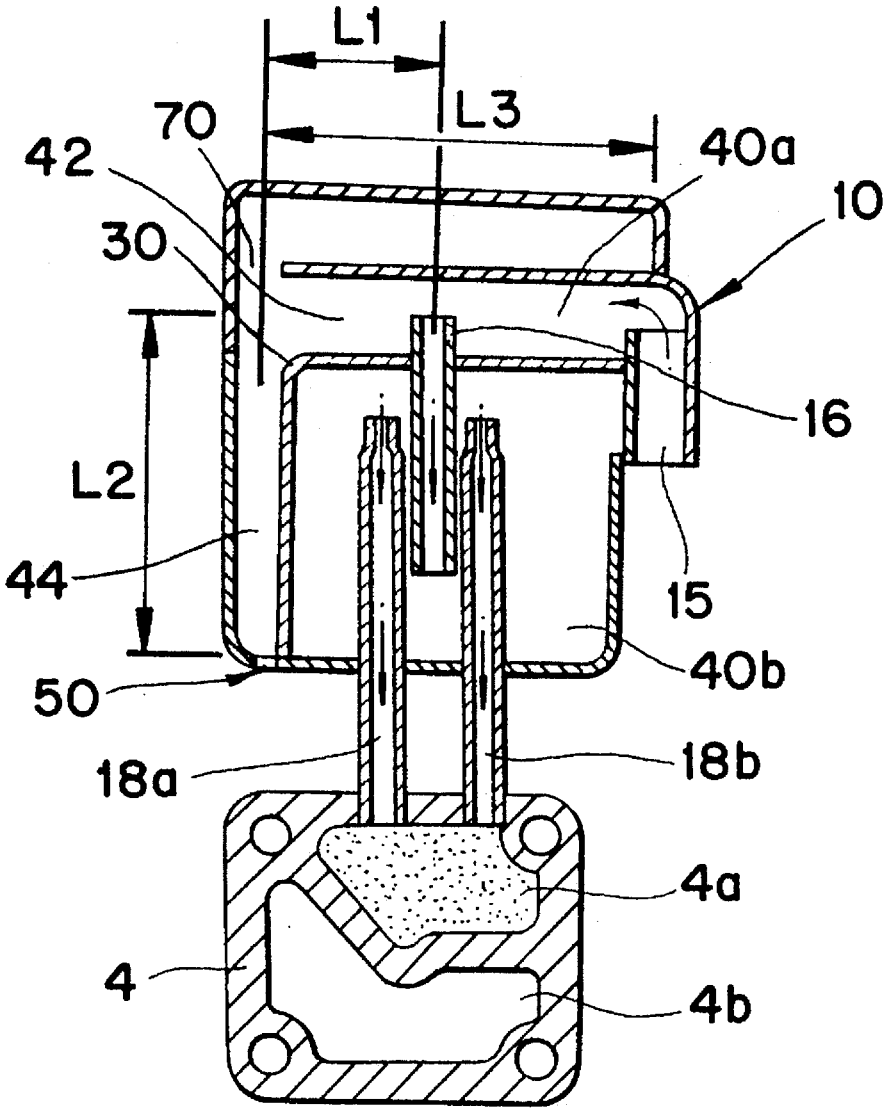
FIG. 4 a sectional view for illustrating other emdodiment of the noise attenuator in accordance with the present invention.

FIG. 4 is a sectional view of a fourth embodiment for a noise attenuator in accordance with the present invention.

In the fourth embodiment, same reference numerals are given to the parts having identical functions as those in the first embodiment.

The difference between the first embodiment and the fourth embodiment illustated in FIG. 4 is that the branch line is in the form of an additional upper area 49 extending along and parallel to the upper surface of the main upper area 42, and communicates therewith via flow hole 70.

At this time, a cavity length L3 extended along the upper surface of the upper chamber 40*a* has the same length as the cavity length L2 extended along the lateral area of the upper chamber 40*a*.

Accordingly, the noise of 500 Hz range generated from the valves of the cylinder head 4 is attenuated by the cavity having a length L1+L2 formed along the upper and lateral areas 42, 44 and by the cavity having a length L1+L3 formed along the upper surface of the upper chamber 40*a*.

Figure 6:
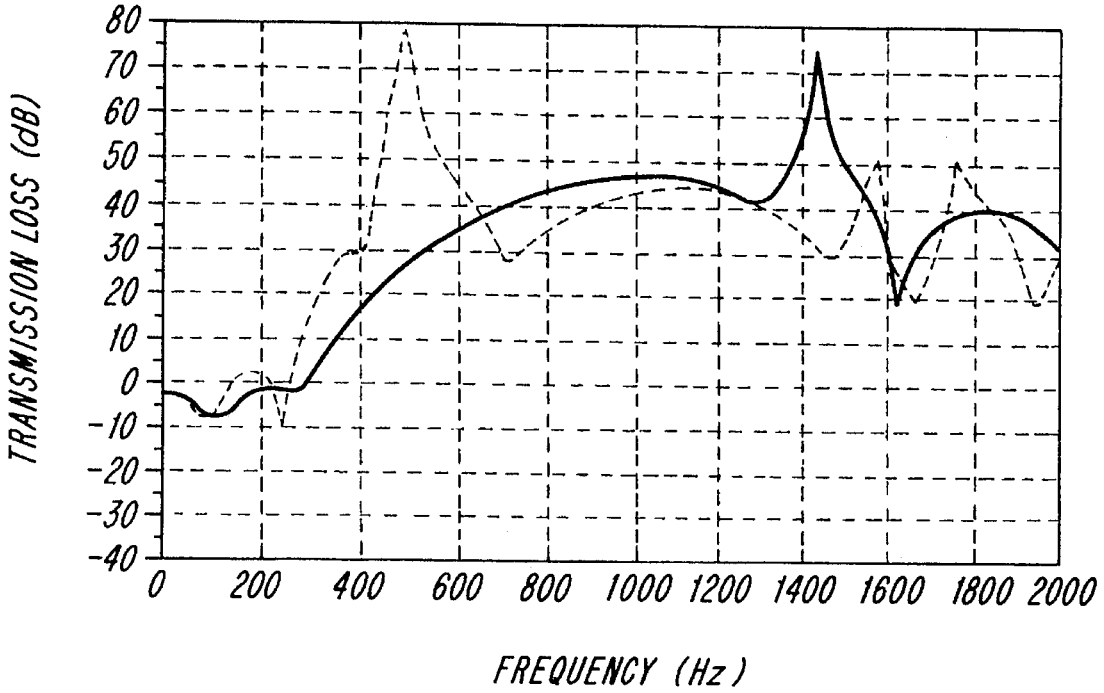

As seen in FIG. 4, the noise attenuator described in the fourth embodiment according to the present invention has a transmission loss as illustrated in dotted lines at FIG. 6.

According to FIG. 6, because the transmission loss at 500 HZ is 80 dB, and if it is assumed that the noise value inputted to the upper chamber 40*a* is 100 dB as in the first embodiment, the noise passing through the suction hole 15 becomes 20 dB, which is markedly low to the user.

As seen from the foregoing, the noise attenuator of a compressor according to the present invention provides an effective apparatus for use in a compressor by attenuating further the noise of 500 Hz range generated from the compressor.

The foregoing description and drawings are illustrative and are not to be taken as limiting. Still other variations and modifications are possible without departing from the spirit and scope of the present invention.

In other words, it should be apparent that the cavities can be extended to both sides of the lower chamber by a predetermined length L2 respectively, two cavities can be extended to either one side of the upper chamber by a predetermined length L2 respectively or the cavities can be extended to the upper surface of the upper chamber by a predetermined length L2.

What is claimed:

1. In combination:

a compressor for compressing refrigerant and including a compressor inlet for receiving refrigerant, and a compressor outlet for discharging compressed refrigerant, the compressor generating a noise having a frequency fr; and a noise attenuator for attenuating the noise, comprising:

a casing defining an interior space having an attenuator inlet for receiving refrigerant, and an attenuator outlet connected to the compressor inlet for supplying refrigerant to the compressor, the interior space being divided by a wall structure into first and second chambers, and a first passage communicating the first chamber with the second chamber, the second chamber being in communication with the compressor inlet by means of the attenuator outlet in the form of a second passage, such that communication of the casing with the compressor inlet occurs solely through the second passage, the first passage comprising a first pipe extending into each of the first and second chambers, the second passage comprising a pair of second pipes extending into the second chamber and projecting through the casing, the pair of second pipes being spaced from the first pipe, the first chamber including a first portion extending in a first direction from the attenuator inlet, and an additional portion extending from a downstream end of the first portion in a lateral direction with respect to the first direction;

the first portion and the additional portion defining a cavity length satisfying the formula $$\frac{C(2n+1)}{4fr},$$

where C is the speed of sound in refrigerant, n is any whole number, including zero, and the cavity length being the sum of: a distance within the first portion from a point where the first portion communicates with the first pipe to a point where the first portion communicates with the additional portion, plus a length of the additional portion.

* * * * *